US008887745B2

(12) United States Patent
Krause

(10) Patent No.: US 8,887,745 B2
(45) Date of Patent: Nov. 18, 2014

(54) MIDPOINT REVERSED DIRECTIONALLY COUPLED DOUBLE CHAMBER STRUCTURE FOR THE NATURAL INDUCTION OF A TORNADO

(76) Inventor: Robert Krause, Bonsall, CA (US)

( * ) Notice: Subject to any disclaimer, the term of this patent is extended or adjusted under 35 U.S.C. 154(b) by 392 days.

(21) Appl. No.: 13/467,836

(22) Filed: May 9, 2012

(65) Prior Publication Data

US 2013/0048086 A1 Feb. 28, 2013

Related U.S. Application Data

(60) Provisional application No. 61/526,030, filed on Aug. 22, 2011.

(51) Int. Cl.
*F15C 1/16* (2006.01)
*F15D 1/00* (2006.01)

(52) U.S. Cl.
CPC ..... *F15D 1/0015* (2013.01)
USPC ..... 137/1; 137/809; 137/812

(58) Field of Classification Search
CPC ..... F15C 1/16; F15C 1/18
USPC ..... 137/808, 809, 810, 811, 812, 1
See application file for complete search history.

(56) References Cited

U.S. PATENT DOCUMENTS

| | | | | |
|---|---|---|---|---|
| 3,323,550 | A * | 6/1967 | Lee, II | 138/39 |
| 3,849,086 | A * | 11/1974 | Johnson | 48/189.4 |
| 4,060,200 | A * | 11/1977 | Mehoudar | 239/542 |
| 4,197,869 | A * | 4/1980 | Moncrieff-Yeates | 137/13 |
| 5,505,229 | A * | 4/1996 | Lee, II | 138/40 |
| 5,687,766 | A * | 11/1997 | Weakley | 137/812 |
| 6,082,387 | A * | 7/2000 | Kanazashi et al. | 137/14 |
| 7,789,108 | B1 * | 9/2010 | Lawson | 138/42 |
| 8,631,827 | B2 * | 1/2014 | Harman | 137/808 |
| 2007/0028977 | A1 * | 2/2007 | Goulet | 137/809 |
| 2009/0272446 | A1 * | 11/2009 | Kolding | 137/808 |

* cited by examiner

*Primary Examiner* — John Rivell
*Assistant Examiner* — Minh Le
(74) *Attorney, Agent, or Firm* — Ahmadshahi & Associates

(57) ABSTRACT

An apparatus generates and/or maintains fluid flow synthesizing and maintaining an artificial tornado. The apparatus includes a generally cylindrical frame having two chambers coupled with two channels each of one half the entire length of the frame, and having reversed angular coordinates. Each chamber operates to generate and/or maintain a vortex and each channel operates to induce and/or reinforce the vortex along the length of the frame.

18 Claims, 5 Drawing Sheets

MIDPOINT REVERSED DIRECTIONALLY COUPLED DOUBLE CHAMBER STRUCTURE FOR THE NATURAL INDUCTION OF A TORNADO

CROSS REFERENCE TO RELATED APPLICATIONS

The present patent application is a formalization of a previously filed co-pending provisional patent application entitled "Midpoint Reversed Directionally Coupled Double Chamber Structure for the Natural Induction of a Tornado," filed Aug. 22, 2011, as U.S. patent application Ser. No. 61/526,030 by the inventor(s) named in this application. This patent application claims the benefit of the filing date of the cited provisional patent application according to the statutes and rules governing provisional patent applications, particularly 35 USC §119 and 37 CFR §1.78. The specification and drawings of the cited provisional patent application are specifically incorporated herein by reference.

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

This invention is related to synthesizing and maintaining an artificial tornado. An apparatus comprises a generally cylindrical frame having two chambers coupled through two channels which are directionally reversed at the midpoint of the frame length. In particular, the two chambers operate to generate and/or maintain two vortices which are induced and/or reinforced by the operation of the two channels.

BACKGROUND

The destructive power of a tornado is well known. It is reasonable to assume that if that power could be harnessed, that same destructive tornado could be used as a source of energy. A methodology to at least one of create and maintain a self-contained compact tornado for power generation purposes is presented. The present invention further discloses an apparatus suitable for synthesizing and maintaining an artificial tornado. It is contemplated that the apparatus of the present invention may alternatively be utilized to trigger natural tornado under favorable atmospheric conditions for purposes of controllably harnessing its power.

In a preferred embodiment, the apparatus includes a generally cylindrical frame of length L which comprises a first and second chambers, each of diameter d, which operate to at least one of generate and maintain a first and second vortices. The first and second chambers are coupled via a first and second channels. Each channel having a length equal to L/2 and whose angular position is reversed at the midpoint along the length of the frame. The channels operate to at least one of induce and reinforce the first and second vortices.

The apparatus was tested utilizing airflow and certain empirical results demonstrate a relationship between output velocity V, frame length L and chamber diameter d. In particular, the output velocity of the airflow from one of the first and second chambers was determined according to equation:

$$V=(K_2)(K_1)^{L/d}$$

where,

V is the output velocity of airflow measured in in/sec, $K_2=7.45\times10^{-5}$ in/sec $K_1=1.000112$ in/sec L≡Frame Length in inches d≡Diameter of the first and second chambers in inches.

In a preferred embodiment, the apparatus is made compact by helically winding the frame along its length into a helical coil. Alternatively, the frame maybe telescopically partitioned along its length into two or more collapsible sections. In yet another preferred embodiment, the frame may comprise a plurality of first and second chambers connected via first and second channels so as to allow multiple artificial tornados.

SUMMARY

In one aspect, an apparatus is disclosed to at least one of generate and maintain fluid flow through the apparatus by construction of a generally cylindrical frame including a first and a second chamber. The first chamber along the frame length operates to at least one of generate and maintain a first vortex through the first chamber and the second chamber along the frame length operates to at least one of generate and maintain a second vortex through the second chamber. A first channel along one half of the frame length connects a first outer region of the first chamber to a first outer region of the second chamber and operates to at least one of induce and reinforce the second vortex. A second channel along the other half of the frame length connects a second outer region of the first chamber to a second outer region of the second chamber and operates to at least one of induce and reinforce the first vortex.

According to one preferred embodiment, a cross section of the cylindrical frame is substantially elliptic.

According to one preferred embodiment, a cross section of the first chamber is substantially, circular. Preferably, a cross section of the second chamber is substantially circular.

According to one preferred embodiment, a cross section of the first channel is substantially rectangular. Preferably, a cross section of the second channel is substantially rectangular.

According to one preferred embodiment, relative to a horizontal axis, the first outer region of the first chamber is substantially at the same angular coordinate as the first outer region of the second chamber, the second outer region of the first chamber is substantially 180 degrees from the angular coordinate of the first outer region of the first chamber, and the second outer region of the second chamber is substantially 180 degrees from the angular coordinate of the first outer region of the second chamber.

According to one preferred embodiment, relative to a horizontal axis, the first outer region of the first chamber is substantially at the opposite angular coordinate as the first outer region of the second chamber, the second outer region of the first chamber is substantially 180 degrees from the angular coordinate of the first outer region of the first chamber, and the second outer region of the second chamber is substantially 180 degrees from the angular coordinate of the first outer region of the second chamber.

According to one preferred embodiment, the fluid flow is airflow. Preferably, a cross section of the first chamber is substantially circular, a cross section of the second chamber is substantially circular, a diameter of the first chamber is equal to the diameter of the second chamber, and an output velocity of the airflow from one of the first and second chambers is determined according to equation:

$$V=(K_2)(K_1)^{L/d}$$

where,

V is the output velocity of airflow measured in in/sec, $K_2=7.45\times10^{-5}$ in/sec $K_1=1.000112$ in/sec L≡Frame Length in inches d≡Diameter of the first and second chambers in inches.

According to one preferred embodiment, the frame is helically wound along the frame length into a helical coil.

According to one preferred embodiment, the frame is telescopically partitioned along the frame length into two or more collapsible sections.

According to one preferred embodiment, the apparatus further comprises a first plug, disposed at an inlet of the second chamber and first channel, which operates to block the fluid flow into the second chamber. Preferably, the apparatus further comprises a second plug, disposed at an outlet of the second chamber and second channel, which operates to block the fluid flow out of the second chamber.

According to one preferred embodiment, the frame comprises a plurality of the first and second chambers connected via first and second channels.

In another aspect, a method for at least one of generating and maintaining fluid flow through an apparatus is disclosed. The apparatus may utilize a generally cylindrical frame having a frame length and the method comprises at least one of generating and maintaining a first vortex through a first chamber included in the frame along the frame length, via the first chamber, at least one of generating and maintaining a second vortex through a second chamber included in the frame along the frame length, via the second chamber, at least one of inducing and reinforcing the second vortex, via a first channel along one half of the frame length, wherein the first channel connects a first outer region of the first chamber to a first outer region of the second chamber, at least one of inducing and reinforcing the first vortex, via a second channel along the other half of the frame length, wherein the second channel connects a second outer region of the first chamber to a second outer region of the second chamber.

According to one preferred embodiment, the method further comprises blocking the fluid flow into the second chamber, via a first plug disposed at an inlet of the second chamber and first channel. Preferably, the method further comprises blocking the fluid flow out of the second chamber, via a second plug disposed at an outlet of the second chamber and second channel.

In yet another aspect, an apparatus is disclosed to at least one of generate and maintain fluid flow through the apparatus by construction of a generally cylindrical frame including a first and a second chamber. The first chamber along the frame length operates to at least one of generate and maintain a first vortex through the first chamber and the second chamber along the frame length operates to at least one of generate and maintain a second vortex through the second chamber. A first channel along the frame length connects a first outer region of the first chamber to a first outer region of the second chamber and operates to at least one of induce and reinforce the second vortex; Preferably, relative to a horizontal axis, the first outer region of the first chamber is substantially at the same angular coordinate as the first outer region of the second chamber. Preferably, relative to a horizontal axis, the first outer region of the first chamber is substantially at the opposite angular coordinate as the first outer region of the second chamber.

BRIEF DESCRIPTION OF THE DRAWINGS

FIG. 1-B is a first side view of the apparatus shown in FIG. 1-A.

DETAILED DESCRIPTION OF THE PRESENTLY PREFERRED EMBODIMENTS

Figure 1A:
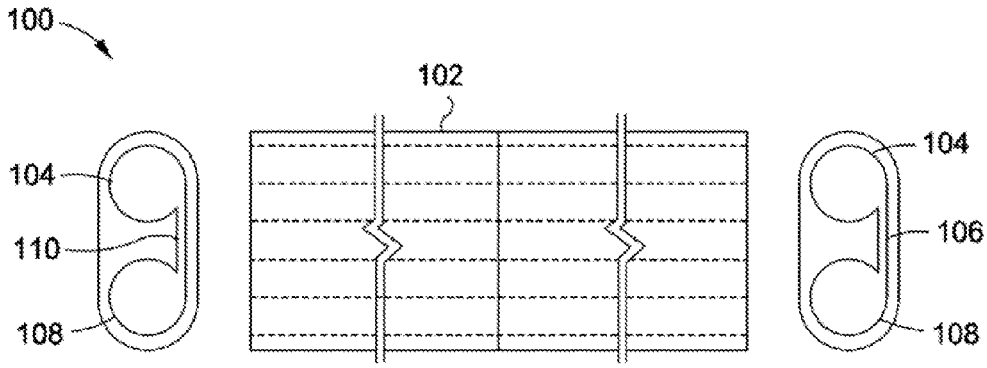
FIG. 1-A is a first top view, including two auxiliary views, of an apparatus capable of generating and/or maintaining fluid flow through the apparatus, according to a preferred embodiment.
Figure 1B:
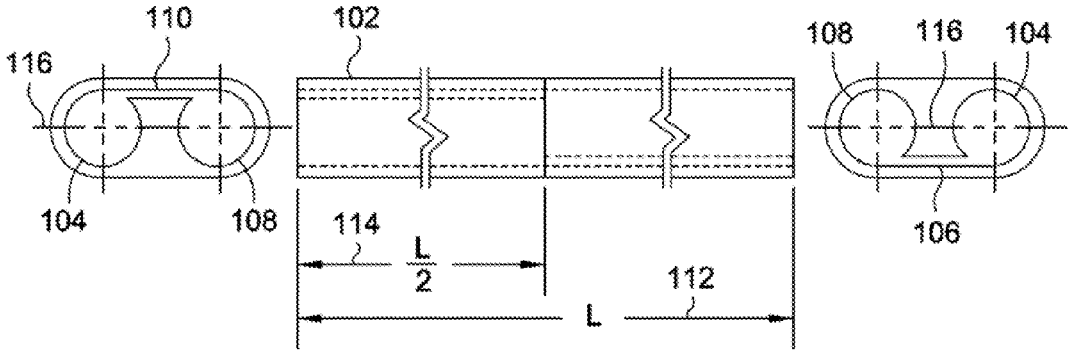

FIGS. 1-A and 1-B show a first top view and a first side view, including their corresponding two auxiliary views, of an apparatus 100 capable of at least one of generating and maintaining fluid flow through the apparatus 100, according to a preferred embodiment. The apparatus 100 comprises a frame 102 which is generally cylindrical having length 112 (L), and half length 114 (L/2). The cross section of the frame 102 is substantially elliptic but other geometrical profiles maybe utilized.

The frame 102 comprises a first chamber 104 and second chamber 108 which extend through the length 112 of the frame 102. The cross sections of the first chamber 104 and second chamber 108 are substantially circular but other geometrical profiles maybe utilized.

The frame 102 further comprises a first channel 106 and second channel 110. The first chamber 104 and second chamber 108 are connected via the first channel 106 and second channel 110. The first channel 106 extends through one half length of the frame 102 and the second channel 110 extends through the other half length of the frame 102.

In particular, the first channel 106 connects a first outer region of the first chamber 104 to a first outer region of the second chamber 108, whereas, the second channel 110 connects a second outer region of the first chamber 104 to a second outer region of the second chamber 108. Accordingly, relative to a horizontal axis 116, the first outer region of the first chamber 104 is at the same angular coordinate, i.e., 270 degrees, as the first outer region of the second chamber 108, and the second outer region of the first chamber 104 and second outer region of the second chamber 108 are substantially 180 degrees from the angular coordinate of the first outer regions of the first chamber 104 and second chamber 108, i.e., 90 degrees. The cross sections of the first channel 106 and second channel 110 are substantially rectangular but other geometrical profiles maybe utilized.

The first chamber 104 operates to at least one of generate and maintain a first vortex through the first chamber 104 and the second chamber 108 operates to at least one of generate and maintain a second vortex through the second chamber 108. The first channel 106 operates to at least one of induce and reinforce the second vortex through the second chamber 108 while the second channel 110 operates to at least one of induce and reinforce the first vortex through the first chamber 104.

Figure 2:
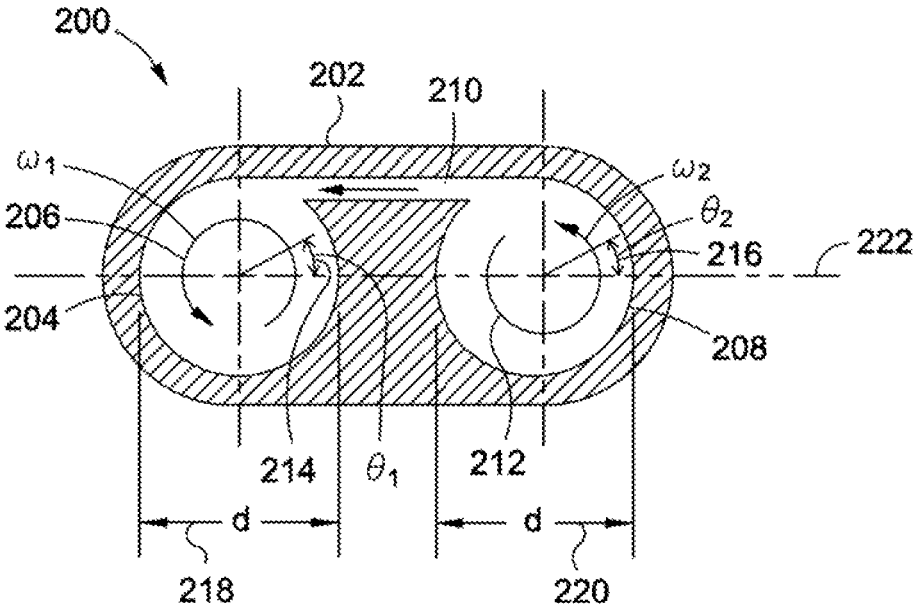
FIG. 2 is a first front view of an apparatus capable of generating and/or maintaining fluid flow through the apparatus, further illustrating the first and second chambers and a second channel, according to a preferred embodiment.

FIG. 2 shows a first front view of an apparatus 200 capable of at least one of generating and maintaining fluid flow through the apparatus 200, according to a preferred embodiment. The apparatus 200 comprises a frame 202. The cross section of the frame 202 is elliptic.

The frame 202 comprises a first chamber 204, a second chamber 208, a first channel (not shown), and a second channel 210. The first channel extends through one half length of the frame 202 and the second channel 210 extends through the other half length of the frame 202. The cross sections of the first chamber 204 and second chamber 208 are circular. The diameter 218 (d) of the first chamber 204 is equal to the diameter 220 of the second chamber 208. Although in this preferred embodiment, the diameters of the first and second chambers 204 and 208 are equal, the apparatus 200 may have chambers of different diameters.

The first channel (not shown) connects a first outer region of the first chamber 204 to a first outer region of the second chamber 208. The second channel 210 connects a second outer region of the first chamber 204 to a second outer region of the second chamber 208. Relative to a horizontal axis 222, the first outer region of the first chamber 204 is at angular coordinate 214 ($\theta_1$) equal to 270 degrees or alternatively −90 degrees, and the first outer region of the second chamber 208 is at the same angular coordinate 216 ($\theta_2$) equal to 270 degrees or alternatively −90 degrees. Relative to the horizontal axis 222, the second outer region of the first chamber 204 and second outer region of the second chamber 208 are substantially 180 degrees from the angular coordinates of the first outer regions of the first chamber 204 and second chamber 208 which is equal to 90 degrees. The cross sections of the first channel (not shown) and second channel 210 are rectangular.

The first chamber 204 operates to at least one of generate and maintain a first vortex 206 at an average rotational speed ($\omega_1$). The second chamber 208 operates to at least one of generate and maintain a second vortex 212 at an average rotational speed ($\omega_2$). According to this preferred embodiment, both first vortex 206 and second vortex 212 rotate in the same direction.

The first channel (not shown) connects the first outer regions of the first and second chambers 204 and 208 along one half length of the frame length, while the second channel 210 connects the second outer regions of the first and second chambers 204 and 208 along the other half of the frame length. The first channel (not shown) allows the tangential component of the fluid flow through the first chamber 204 into the second chamber 208, operating to at least one of induce and reinforce the second vortex 212 through the second chamber 208, while the second channel 210 allows the tangential component of the fluid flow through the second chamber 208 into the first chamber 204, operating to at least one of induce and reinforce the first vortex 206 through the first chamber 204.

Figure 3:
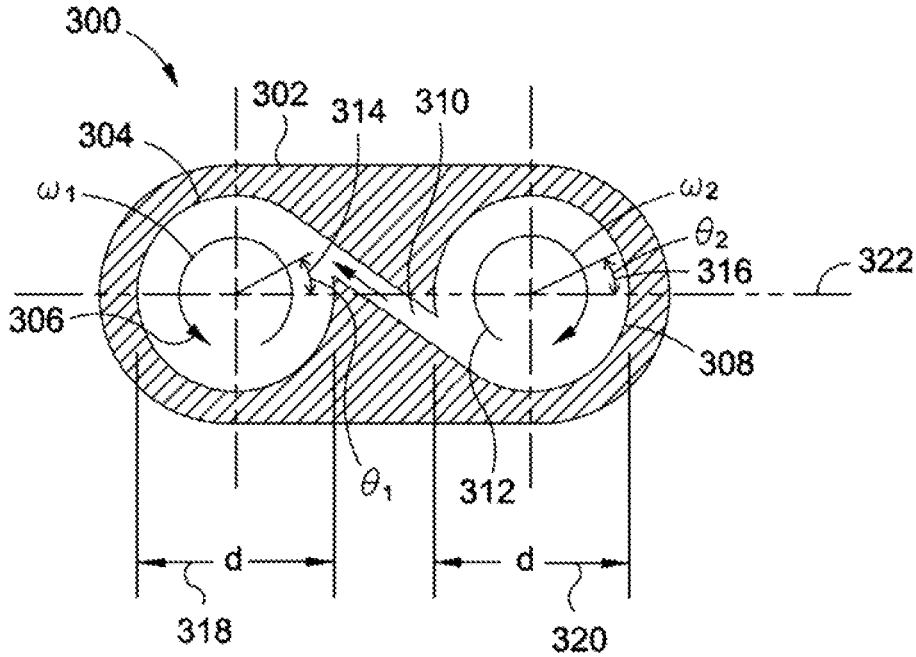
FIG. 3 is a first front view of an apparatus capable of generating and/or maintaining fluid flow through the apparatus, further illustrating the first and second chambers and a second channel, according to a preferred embodiment.

FIG. 3 shows a first front view of an apparatus capable of at least one of generating and maintaining fluid flow through the apparatus 300, according to a preferred embodiment. The apparatus 300 comprises a frame 302. The cross section of the frame 302 is elliptic.

The frame 302 comprises a first chamber 304, a second chamber 308, a first channel (not shown), and a second channel 310. The first channel extends through one half length of the frame 302 and the second channel 310 extends through the other half length of the frame 302. The cross sections of the first chamber 304 and second chamber 308 are circular. The diameter 318 (d) of the first chamber 304 is equal to the diameter 320 of the second chamber 308. As stated above in relation to FIG. 2, although in this preferred embodiment, the diameters of the first and second chambers 304 and 308 are equal, the apparatus 300 may have chambers of different diameters.

The first channel (not shown) connects a first outer region of the first chamber 304 to a first outer region of the second chamber 308. The second channel 310 connects a second outer region of the first chamber 304 to a second outer region of the second chamber 308. Relative to a horizontal axis 322, the first outer region of the first chamber 304 is at angular coordinate 314 ($\theta_1$) equal to 315 degrees or alternatively −45 degrees, and the first outer region of the second chamber 308 is at opposite angular coordinate 316 ($\theta_2$) equal to 135 degrees. Relative to the horizontal axis 322, the second outer region of the first chamber 304 and second outer region of the second chamber 308 are substantially 180 degrees from the angular coordinates of the first outer regions of the first chamber 304 and second chamber 308 which is equal to 45 degrees and 225 degrees, respectively. The cross sections of the first channel (not shown) and second channel 310 are rectangular.

The first chamber 304 operates to at least one of generate and maintain a first vortex 306 at an average rotational speed ($\omega_1$). The second chamber 308 operates to at least one of generate and maintain a second vortex 312 at an average rotational speed ($\omega_2$). According to this preferred embodiment, first vortex 306 and second vortex 312 rotate in opposite direction.

The first channel (not shown) connects the first outer regions of the first and second chambers 304 and 308 along one half length of the frame length, while the second channel 310 connects the second outer regions of the first and second chambers 304 and 308 along the other half of the frame length. The first channel (not shown) allows the tangential component of the fluid flow through the first chamber 304 into the second chamber 308, operating to at least one of induce and reinforce the second vortex 312 through the second chamber 308, while the second channel 310 allows the tangential component of the fluid flow through the second chamber 308 into the first chamber 304, operating to at least one of induce and reinforce the first vortex 306 through the first chamber 304.

Figure 4:
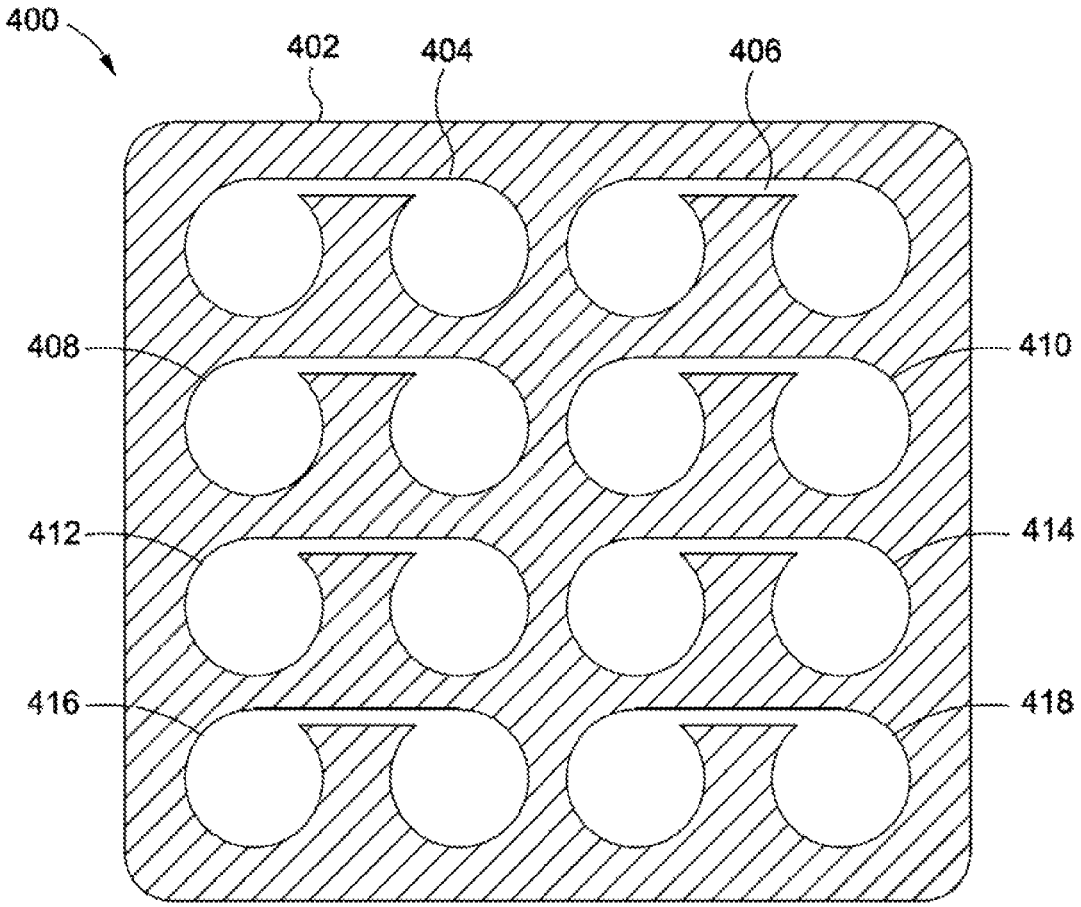
FIG. 4 is a first front view of an apparatus capable of generating and/or maintaining fluid flow through the apparatus, further illustrating plurality of first and second chambers and channels, according to a preferred embodiment.

FIG. 4 shows a first front view of an apparatus 400 capable of at least one of generating and maintaining fluid flow through the apparatus 400, according to a preferred embodiment. The apparatus 400 comprises a frame 402. The cross section of the frame 402 is rectangular. The frame 402 comprises plurality of first and second chambers and corresponding first and second channels. According to this preferred embodiment, the frame 402 comprises 8 such units, each unit operating similar to that described above in relation with FIGS. 1-3.

Figure 5:
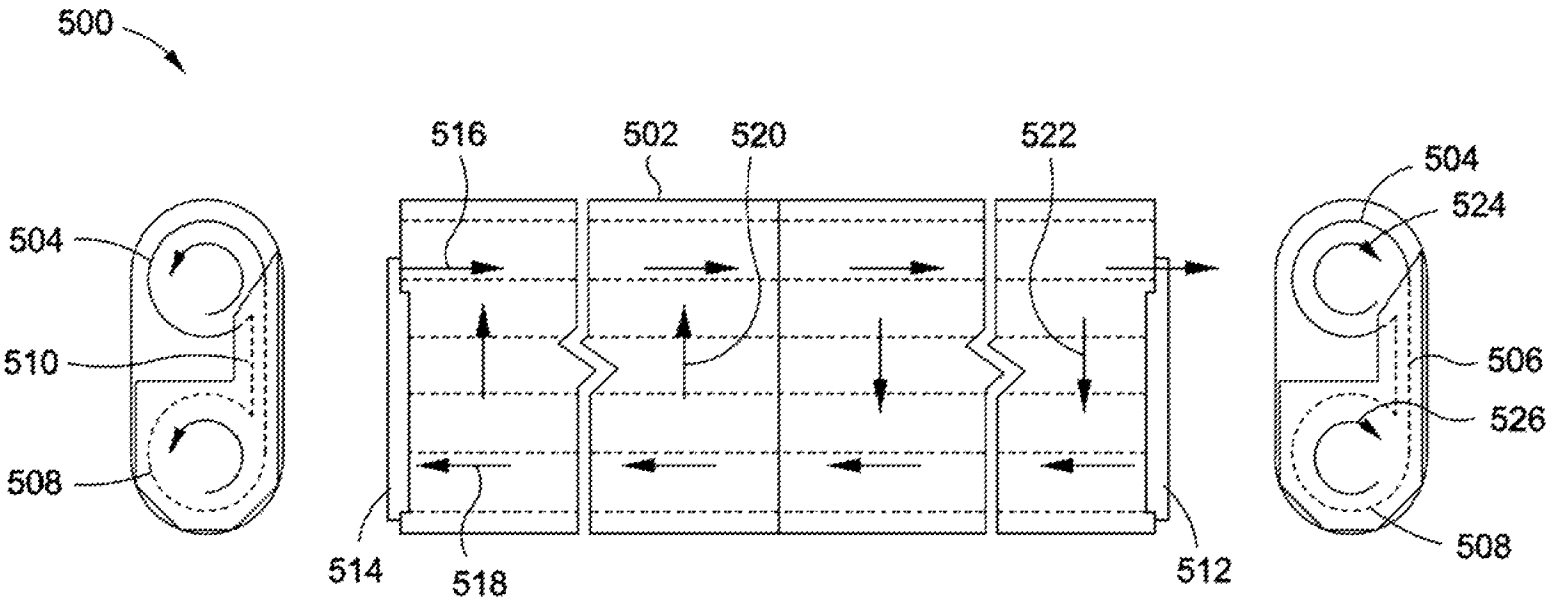
FIG. 5 is a first top view, including two auxiliary views, of an apparatus capable of generating and/or maintaining fluid flow through the apparatus, further having a first and second plugs and illustrating time average fluid flow through the apparatus, according to a preferred embodiment.

FIG. 5 shows a first top view, including two auxiliary views, of an apparatus 500 capable of at least one of generating and maintaining fluid flow through the apparatus 500, according to a preferred embodiment. The apparatus 500 comprises a frame 502 which is generally cylindrical having length (L), and half length (L/2), similar to that shown in FIG. 1. The cross section of the frame 502 is substantially elliptic but other geometrical profiles maybe utilized.

The frame 502 comprises a first chamber 504 and second chamber 508 which extend through the length (L) of the frame 502. The cross sections of the first chamber 504 and second chamber 508 are substantially circular but other geometrical profiles maybe utilized.

The frame 502 further comprises a first channel 506 and second channel 510. The first chamber 504 and second chamber 508 are connected via the first channel 506 and second channel 510. The first channel 506 extends through one half length of the frame 502 and the second channel 510 extends through the other half length of the frame 502. The frame 502 further comprises a first plug 512 and a second plug 514. FIG. 5 further illustrates time average fluid flow, in this case airflow, through the apparatus 500.

The first chamber 504 operates to at least one of generate and maintain a first vortex 524 through the first chamber 504 and the second chamber 508 operates to at least one of generate and maintain a second vortex 526 through the second chamber 508. The first channel 506 operates to at least one of induce and reinforce the second vortex 526 through the second chamber 508 while the second channel 510 operates to at least one of induce and reinforce the first vortex 524 through the first chamber 504. According to this preferred embodiment, the first plug 512 and second plug 514 block fluid flow into and out of the second chamber 508.

According to this preferred embodiment, an output velocity 516 (V) of the airflow from the first chamber 504 is determined according to equation:

$$V=(K_2)(K_1)^{L/d}$$

where,

V is the output velocity of airflow measured in in/sec, $K_2=7.45\times10^{-5}$ in/sec $K_1=1.000112$ in/sec L≡Frame Length in inches d≡Diameter of the first and second chambers in inches.

Although, in the above equation, the output velocity 516 is calculated for the airflow from the first chamber 504, a similar equation would follow for the output velocity 518 of the airflow from the second chamber 508 if the first plug 512 and second plug 514 are removed, rendering the apparatus equivalent to the apparatus 100 shown in FIG. 1. The directions of first airflow 522 through the first channel 506 and second airflow 520 through the second channel 510 are as shown given the directions of the first vortex 524 and second vortex 526 as depicted in FIG. 5. Furthermore, the axial direction of the output velocity in the first and second chambers 504 and 508 may be the same or opposite one another.

The apparatuses 100, 200, 300, 400, or 500 are suitable for synthesizing and maintaining an artificial tornado. It is contemplated that these apparatuses may also be utilized to trigger natural tornado under favorable atmospheric conditions for purposes of controllably harnessing its power. In either application, a turbine maybe coupled to the apparatus, such as apparatus 500, and an electrical generator such that the apparatus 500 turns the turbine which in turn runs the generator to produce electrical power.

Figure 6:
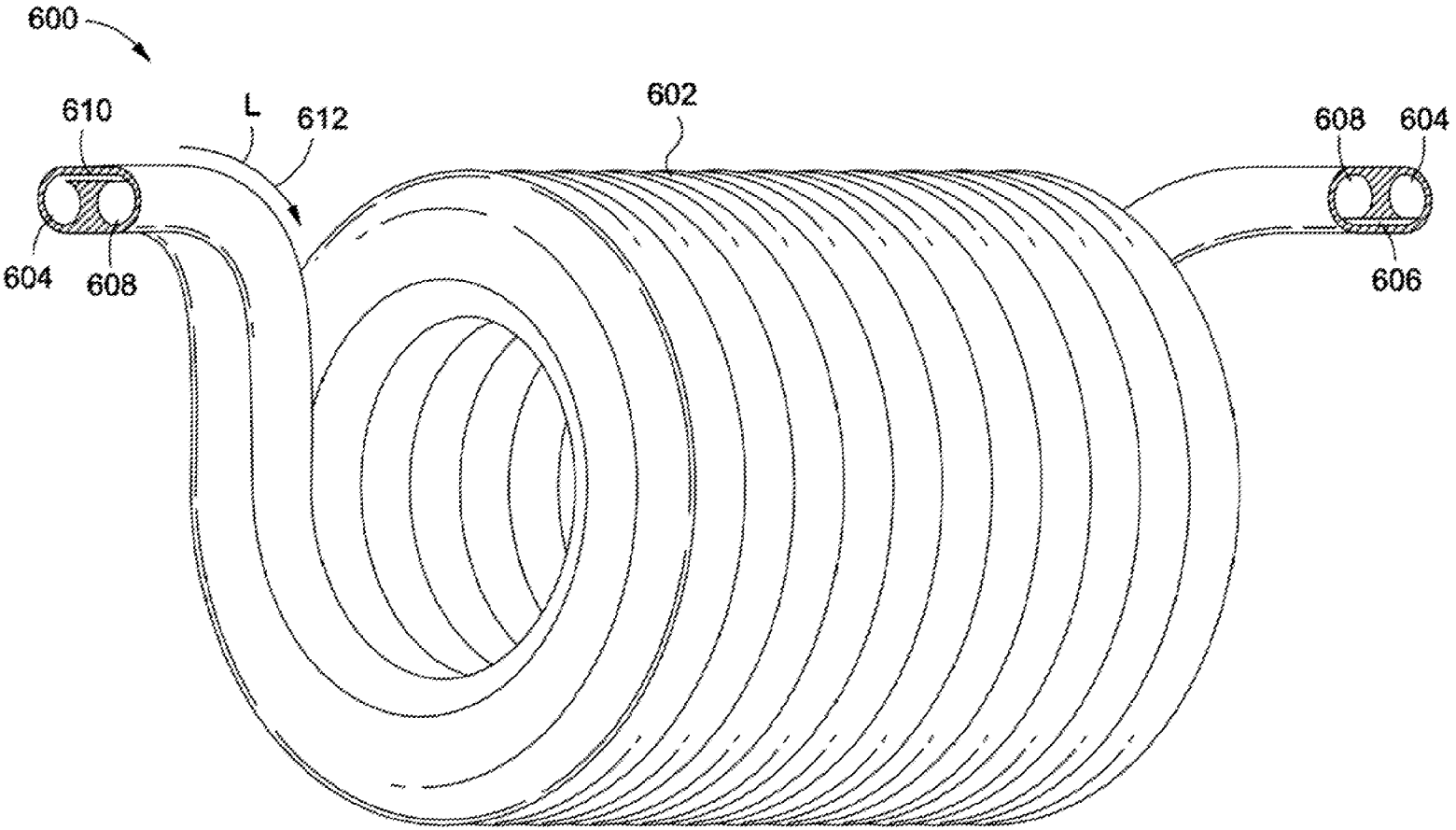
FIG. 6 is a first perspective view, including two auxiliary views, of an apparatus capable of generating and/or maintaining fluid flow through the apparatus whose frame is helically wound along its length into a helical coil, according to a preferred embodiment.

FIG. 6 shows a first perspective view, including two auxiliary views, of an apparatus 600 capable of at least one of generating and maintaining fluid flow through the apparatus 600, according to a preferred embodiment. The apparatus 600 comprises a frame 602 which is generally cylindrical having length 612 (L), and half length (L/2), similar to that shown in FIG. 1. The cross section of the frame 602 is substantially elliptic but other geometrical profiles maybe utilized.

The frame 602 comprises a first chamber 604 and second chamber 608 which extend through the length 612 of the frame 602. The cross sections of the first chamber 604 and second chamber 608 are substantially circular but other geometrical profiles maybe utilized.

The frame 602 further comprises a first channel 606 and second channel 610. The first chamber 604 and second chamber 608 are connected via the first channel 606 and second channel 610. The first channel 606 extends through one half length of the frame 602 and the second channel 610 extends through the other half length of the frame 602. For compactness, the frame 602 is helically wound along its length into a helical coil, according to this preferred embodiment.

The foregoing discloses apparatus, including method of operation, operative to at least one of generate and maintain fluid flow, thus, synthesizing and maintaining an artificial tornado. The apparatus includes a generally cylindrical frame with two chambers coupled via two channels each of one half the entire length of the frame, and having reversed angular coordinates. Each chamber operates to at least one of generate and maintain a vortex and each channel operates to at least one of induce and reinforce the vortex along the length of the frame. The linear and angular dimensions of the apparatus, its parts and/or components are contemplated to include a wide range of values. Although, the tests were performed utilizing a prototype apparatus having dimensions of a few inches and feet, it is contemplated that the range of values for chamber diameter or apparatus length of a manufactured unit would reside between the values of as low as a fraction of 1 inch to as high as 1 mile.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. An apparatus operative to at least one of generate and maintain fluid flow through the apparatus, said apparatus comprising a generally cylindrical frame having a frame length, said frame comprising:

(a) a first chamber along the frame length, operative to at least one of generate and maintain a first vortex through the first chamber;

(b) a second chamber along the frame length, operative to at least one of generate and maintain a second vortex through the second chamber;

(c) a first channel along one half of the frame length, wherein the first channel connects a first outer region of the first chamber to a first outer region of the second chamber and is operative to at least one of induce and reinforce the second vortex; and (d) a second channel along the other half of the frame length, wherein the second channel connects a second outer region of the first chamber to a second outer region of the second chamber and is operative to at least one of induce and reinforce the first vortex.

2. The apparatus of claim 1, wherein a cross section of the cylindrical frame is substantially elliptic.

3. The apparatus of claim 1, wherein a cross section of the first chamber is substantially circular.

4. The apparatus of claim 3, wherein a cross section of the second chamber is substantially circular.

5. The apparatus of claim 1, wherein a cross section of the first channel is substantially rectangular.

6. The apparatus of claim 5, wherein a cross section of the second channel is substantially rectangular.

7. The apparatus of claim 1, wherein, relative to a horizontal axis, the first outer region of the first chamber is substantially at the same angular coordinate as the first outer region of the second chamber, and wherein the second outer region of the first chamber is substantially 180 degrees from the angular coordinate of the first outer region of the first chamber, and wherein the second outer region of the second chamber is substantially 180 degrees from the angular coordinate of the first outer region of the second chamber.

8. The apparatus of claim 1, wherein, relative to a horizontal axis, the first outer region of the first chamber is substantially at the opposite angular coordinate as the first outer region of the second chamber, and wherein the second outer region of the first chamber is substantially 180 degrees from the angular coordinate of the first outer region of the first chamber, and wherein the second outer region of the second chamber is substantially 180 degrees from the angular coordinate of the first outer region of the second chamber.

9. The apparatus of claim 1, wherein the fluid flow is airflow.

10. The apparatus of claim 9, wherein a cross section of the first chamber is substantially circular, and wherein a cross section of the second chamber is substantially circular, and wherein a diameter of the first chamber is equal to the diameter of the second chamber, and wherein an output velocity of the airflow from one of the first and second chambers is determined according to equation:

$$V=(K_2)(K_1)^{L/d}$$

where,

V is the output velocity of airflow measured in in/sec, $K_2=7.45\times10^{-5}$ in/sec $K_1=1.000112$ in/sec L≡Frame Length in inches d≡Diameter of the first and second chambers in inches.

11. The apparatus of claim 1, wherein the frame is helically wound along the frame length into a helical coil.

12. The apparatus of claim 1, wherein the frame is telescopically partitioned along the frame length into two or more collapsible sections.

13. The apparatus of claim 1, further comprising a first plug disposed at an inlet of the second chamber and first channel, operative to block the fluid flow into the second chamber.

14. The apparatus of claim 13, further comprising a second plug disposed at an outlet of the second chamber and second channel, operative to block the fluid flow out of the second chamber.

15. The apparatus of claim 1, wherein the frame comprises a plurality of the first and second chambers connected via first and second channels.

16. A method for at least one of generating and maintaining fluid flow through an apparatus, said apparatus comprising a generally cylindrical frame having a frame length, said method comprising:

(a) at least one of generating and maintaining a first vortex through a first chamber included in the frame along the frame length, via the first chamber;

(b) at least one of generating and maintaining a second vortex through a second chamber included in the frame along the frame length, via the second chamber;

(c) at least one of inducing and reinforcing the second vortex, via a first channel along one half of the frame length, wherein the first channel connects a first outer region of the first chamber to a first outer region of the second chamber; and (d) at least one of inducing and reinforcing the first vortex, via a second channel along the other half of the frame length, wherein the second channel connects a second outer region of the first chamber to a second outer region of the second chamber.

17. The method of claim 16, further comprising:

(e) blocking the fluid flow into the second chamber, via a first plug disposed at an inlet of the second chamber and first channel.

18. The method of claim 17, further comprising:

(f) blocking the fluid flow out of the second chamber, via a second plug disposed at an outlet of the second chamber and second channel.

* * * * *